United States Patent [19]

Gresset

[11] 4,135,303

[45] Jan. 23, 1979

[54] TOY SUCH AS A BOARD

[75] Inventor: Bernard F. Gresset, Neuilly sur Seine, France

[73] Assignee: Jouets Educatifs Universels, Drancy, France

[21] Appl. No.: 816,348

[22] Filed: Jul. 18, 1977

[51] Int. Cl.[2] ..... B43L 13/00

[52] U.S. Cl. ..... 33/18 R

[58] Field of Search ..... 33/1 M, 18 R, 23 C; 346/21, 29, 139 R, 139 B

[56] References Cited

U.S. PATENT DOCUMENTS

| | | | |
|---|---|---|---|
| 1,512,015 | 10/1924 | Butz et al. | 33/23 C |
| 3,055,113 | 9/1962 | Grandjean | 33/18 R |
| 3,331,082 | 7/1967 | Sheets | 346/139 R |
| 3,333,273 | 7/1967 | Kallen et al. | 346/139 R |
| 3,360,799 | 12/1967 | Polster | 346/139 B |

*Primary Examiner*—Charles E. Phillips
*Attorney, Agent, or Firm*—Charles Hieken

[57] ABSTRACT

The invention provides a toy of the type consisting of a box wherein there is a tracing device making it possible to draw forms on a translucent screen previously coated with an opaque pulverulent powder by applying a stiletto on to said screen, a toy wherein the base of said box carries at least two stirrups hinged about bearings, said stirrups co-operating with screws operating the downwards and upwards motions of said stirrups which actuate one of the rods carrying the stiletto so as to move it away from the screen or bring it closer to same, said screws being integral with driving studs arranged on the upper surface of the box.

6 Claims, 2 Drawing Figures

TOY SUCH AS A BOARD

BACKGROUND OF THE INVENTION

The invention provides a toy such as a board of the type consisting of a box carrying a tracing device making it possible to draw forms on a translucent screen.

Toys consisting of a box made of two parts are already known, the first part of same carrying a translucent screen, the second part constituting the base carrying a tracing device coming into contact with said screen. Also, the part of the box constituting the base carries a cavity serving as a reserve for a bronze powder mixed with glass balls which cover the translucent screen of the upper part by putting the box upside down. By actuating the driving stubs of said tracing device, the user thereof may then make drawings or forms by operating the movement of the stiletto of the tracing device coming into contact with the translucent screen covered with fine powder. Thus, the user makes lines as said stiletto scratches the fine layer of pulverulent powder previously laid down on the screen.

However, said traditional toys show the drawback of not making it possible to reproduce several forms side by side without said forms being linked to each other by a line made by the tracing device which permanently remains in contact with the translucent screen.

The present invention has as an object to remedy said drawback and provides to this end a toy making it possible to set out various forms or drawings located side by side on a translucent screen without said various forms or drawings being linked to one another by lines.

SUMMARY OF THE INVENTION

To this end, the invention provides a toy of the type carrying a box wherein there is a tracing device making it possible to draw forms on a translucent screen previously coated with an opaque pulverulent powder by applying a stiletto on to said screen, a toy wherein said box carries a base with at least two stirrups hinged about bearings, said stirrups co-operating with screws operating the downwards and upwards motions of said stirrups actuating one of the rods carrying the stiletto so as to move it away from the screen or bring it closer to same, said screws being integral with driving studs arranged on the upper surface of the box.

According to a further characteristic feature of the invention, the user of the toy may make several drawings on the translucent screen previously coated with an opaque pulverulent powder without said various drawings being linked by a line to one another. As a matter of fact, by actuating the screws operating the downwards and upwards motions of the stirrups, it is possible to move the stiletto away from the screen in order to make a further drawing at another place on said screen. By bringing again said stiletto closer to the screen by screwing the operating stubs in an opposite sense, it is then possible to achieve another form.

According to another characteristic feature of the invention, the screws actuating the stirrups carry at their lower portion a helicoidal ramp on which said stirrups rest.

Thus, it suffices to actuate the screws to lift up or lower said stirrups so as to move the stiletto away from the screen or to bring it closer to same.

The invention will be better understood with the aid of a mode of embodiment of a toy shown by way of non-limitative example in the attached drawings, wherein:

DETAILED DESCRIPTION OF PREFERRED EMBODIMENTS

Figure 1:
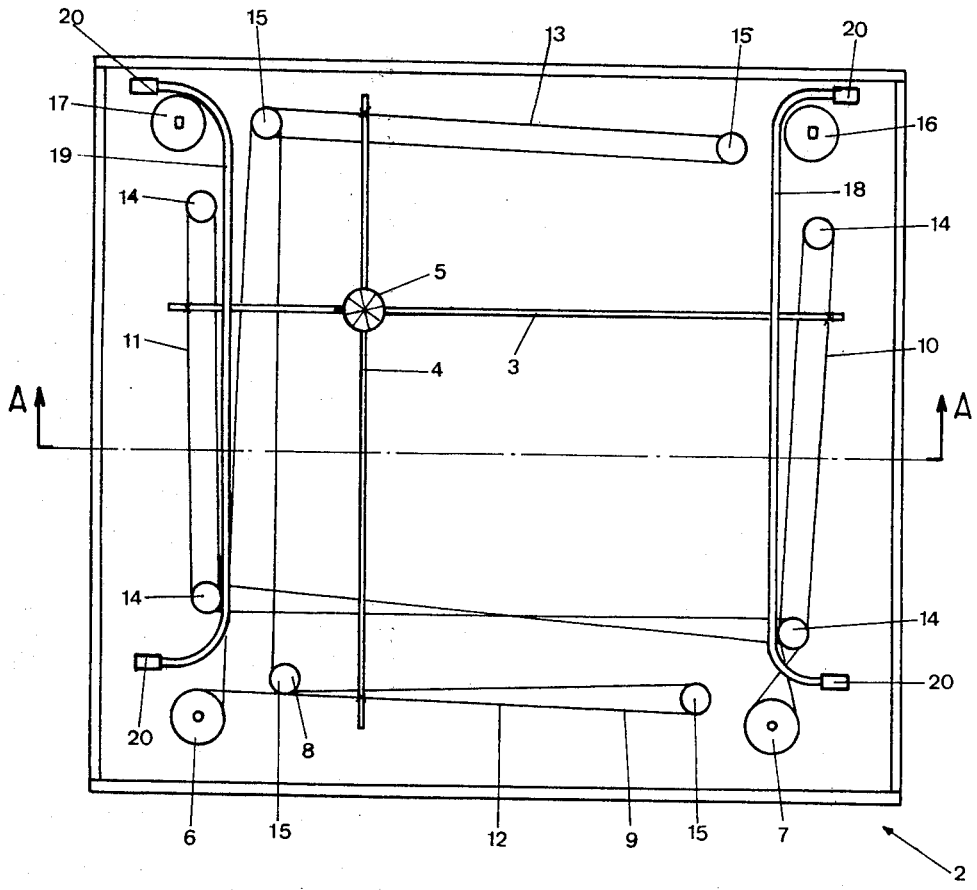
FIG. 1 is a view from above of the lower part of the toy.

As shown in FIG. 1, the lower part 2 of the toy, constituting a base, carries a tracing device consisting of two rods 3, 4 arranged perpendicular to one another and carrying a stiletto 5. Said two rods are movable in relation to each other to provide rectilinear scanning and drive said stiletto 5 when respectively traveling. The travelings of the rods 3 and 4 and accordingly of the stiletto 5 are operated by studs or pulleys 6, 7 connected by a thread 9 to driving rollers. Said rod 3 is secured to the strands 10 and 11 of said thread 9, while the bar 4 is secured to the strands 12 and 13 of the thread 9.

Thus, by actuating the stud or pulley 7 through screwing in any way whatever, the user of the toy operates the traveling of the rod 3 by driving the group of rollers 14. The bar moves downwards the base, or inversely, which results in vertical lines on the translucent screen not shown in FIG. 1.

When the user actuates the stud or pulley 6, the latter operates the traveling of the bar 4 by driving the group of rollers 15. Said bar traveling from the left hand to the right hand of the base, or inversely, this results in horizontal lines on the translucent screen.

The lower portion 2 of said toy also carries operating studs 16, 17 co-operating with stirrups 18, 19 hinged about rollers 20. When screwing the operating studs 16, 17, the user causes the lifting up or the lowering of said stirrups 18, 19 which actuate the rod 3 so as to push it towards the bottom or, on the contrary, to release it upwards by screwing said studs 16, 17 in an opposite way in order to move the stiletto 5 away from the translucent screen or to bring it closer to same.

Figure 2:
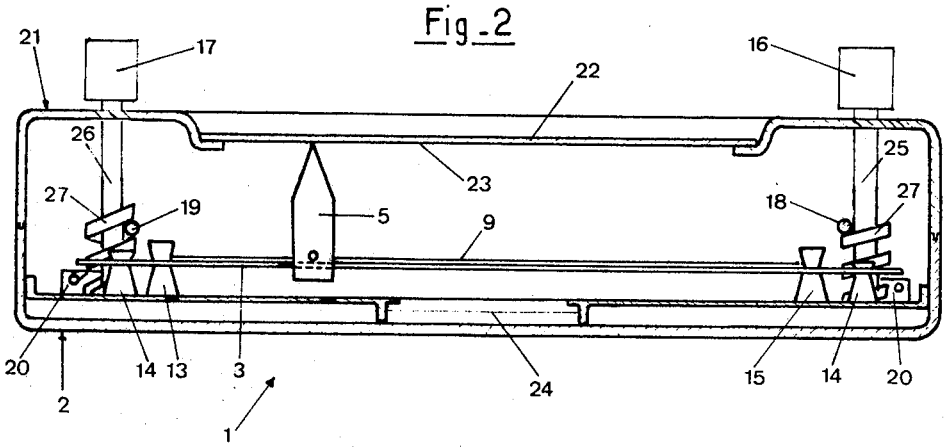
FIG. 2 is a cross-section view along A—A of the whole of the box.

As shown in FIG. 2, the toy 1 consists of a box with a lower portion 2 and an upper portion 21.

Said upper portion 21 carries a translucent screen 22 whose lower surface 23 is coated with an opaque pulverulent powder such as bronze powder mixed with glass balls. Said powder covers said surface 23 by putting the toy 1 upside down.

The lower portion 2 of the toy 1 carries the tracing device consisting of rods 3 and 4 (only the rod 3 is shown) carrying the stiletto 5 applied against the surface 23 of the screen 22 when working the toy.

The traveling of the rods 3 and 4 is operated by studs or pulleys 6 and 7, not-shown in FIG. 2, by driving the rollers 14 and 15. Said operating studs or pulleys 6 and 7 as well as the whole of the rollers 14 and 15 are connected to each other by a thread 9 allowing the stiletto 5 to travel on the screen 22.

The lower portion 2 carries a cavity 24 at its median portion which provides a reserve of powder designed to be applied against the surface 23 of the screen 22 when drawing is performed or said drawing erazed by simply turning the toy 1 upside down.

Also, said lower portion 2 carries at its bottom the screws 25, 26 co-operating with the stirrups 18, 19 hinged about the bearings 20. The operating studs 16, 17 not shown in FIG. 2 are positioned by nesting said screws 25, 26 in the upper portion of the toy.

Said screws 25, 26 carry a helicoidal ramp 27 making it possible, through screwing in one way or another, to lower or lift up the stirrups 18, 19 so as to actuate the rod 3 carrying the stiletto 5 in order to move said stiletto 5 away from the screen 22 or, on the contrary, to apply it on to the surface 23 of the screen 22.

It is possible to lower or lift up said rod 3 because of the flexibility of the thread 9 to which the rods 3 and 4 are secured, said thread 9 connecting the studs or pulleys 6 and 7 as well as the whole of the rollers 14 and 15 to each other.

Of course, the invention is not limited to the example of embodiment disclosed and depicted hereabove, from which other variants can be provided without thereby departing from the scope of the invention.

What we claim is:

1. In a toy of the type having a box with a translucent screen coated with an opaque pulverulent powder wherein there is a tracing device making it possible to draw forms on the translucent screen by applying a stiletto carried by a plurality of rods on to said screen, the improvement wherein the box carries on its base at least two stirrups hinged about bearings, screws each having means for accommodating a stirrup, means including said means for accommodating for causing said stirrups to co-operate with said screws in operating the lowering or raising of said stirrups to actuate one of the rods carrying the stiletto so as to move it away from the screen or bring it closer to same, said screws being integral with operating studs distributed on the upper surface of said box.

2. A toy according to claim 1, wherein the screws actuating the stirrups carry at their lower portion a helicoidal ramp on which said stirrups rest comprising said means for accommodating.

3. A toy according to claim 2, wherein the stirrups consist of rods whose ends are bent, said rods being arranged parallel to one another and extending along two opposite edges of the lower portion of the toy.

4. In a toy of the type having a box with a translucent screen coated with an opaque pulverulent powder and a stiletto carried by a plurality of rods for drawing forms on the screen with the stiletto, the improvement comprising, means actuated from a location on the outside of said box and coupled to said rods for selectively displacing said stiletto to and from said screen, said means comprising stirrup means hinged about bearing means for actuating one of the rods carrying the stiletto so as to move it to and from the screen, and means including screw means integral with the means outside said box for coating with said stirrup means for displacing said stirrup means and thereby actuating one of said rods, whereby an operator may exercise control over said stiletto to produce drawings on said screen without consecutively inscribed drawings being linked to one another by lines visible on said screen.

5. The improvement in accordance with claim 4 wherein said screw means includes a helicoidal ramp on which said stirrup means rests.

6. The improvement in accordance with claim 5 wherein said stirrup means comprises rods whose ends are bent, said rods being arranged with the standing portions between the bent ends generally parallel to one another and extending along to opposite edges of said box.

* * * * *